US005236393A

United States Patent [19]

Milewski

[11] Patent Number: 5,236,393

[45] Date of Patent: Aug. 17, 1993

[54] BYPASS DAMPER IN SERIES-TYPE VENTILATION FAN

[75] Inventor: Les Milewski, Clearwater, Fla.

[73] Assignee: Metal Industries, Inc., Clearwater, Fla.

[21] Appl. No.: 995,541

[22] Filed: Dec. 22, 1992

Related U.S. Application Data

[63] Continuation of Ser. No. 750,944, Aug. 28, 1991, abandoned.

[51] Int. Cl.[5] ..... F24F 13/04

[52] U.S. Cl. ..... 454/266; 454/269

[58] Field of Search ..... 454/265, 266, 269

[56] References Cited

U.S. PATENT DOCUMENTS

| | | | |
|---|---|---|---|
| 1,018,925 | 2/1912 | Pruden . | |
| 1,862,289 | 6/1932 | Anderson | 415/745 |
| 2,055,193 | 9/1936 | Rischoff | 230/115 |
| 2,698,711 | 1/1955 | Newcomb | 230/114 |
| 2,923,125 | 2/1960 | Rainbow | 60/35.6 |
| 3,173,656 | 3/1965 | du Preez | 253/52 |
| 3,297,307 | 1/1967 | Jahns | 259/97 |
| 3,309,057 | 3/1967 | Tonooka | 253/1 |
| 3,356,034 | 12/1967 | Knowles et al. | 103/97 |
| 3,378,198 | 4/1968 | Von Otto | 454/269 X |
| 3,638,428 | 2/1972 | Shipley et al. | 60/226 |
| 3,706,510 | 12/1972 | O'Connor | 415/145 |
| 3,747,341 | 7/1973 | Davis | 60/226 A |
| 3,813,184 | 5/1974 | Temple et al. | 415/54 |
| 3,951,205 | 4/1976 | Zilbermann | 454/269 X |
| 3,951,566 | 4/1976 | Mattei et al. | 415/115 |
| 4,127,356 | 11/1978 | Murphy | 415/2 |
| 4,284,386 | 8/1981 | Hudson | 415/209 |
| 4,352,453 | 10/1982 | McNabney | 454/266 X |
| 4,396,345 | 8/1983 | Hutchinson | 415/28 |
| 4,439,095 | 3/1984 | Galtz et al. | 415/52 |
| 4,470,342 | 9/1984 | Hall, Jr. | 454/269 X |
| 4,490,602 | 12/1984 | Ishihara | 219/370 |
| 4,560,103 | 12/1985 | Schulz et al. | 454/269 X |
| 4,657,178 | 4/1987 | Meckler | 454/265 X |
| 4,715,779 | 12/1987 | Suciu | 415/144 |
| 4,749,338 | 6/1988 | Galtz | 415/145 |

*Primary Examiner*—William E. Tapolcai

*Attorney, Agent, or Firm*—Finnegan, Henderson, Farabow, Garrett & Dunner

[57] ABSTRACT

A series-type fan includes an air intake exposed to both ambient and forced ventilation air, a variable capacity fan, and multiple ports positioned downstream from the fan. One of the ports has a damper attached thereto which closes when the fan is de-energized to prevent backspin of the fan.

7 Claims, 5 Drawing Sheets

BYPASS DAMPER IN SERIES-TYPE VENTILATION FAN

This application is a continuation of U.S. Ser. No. 07/750,944, filed Aug. 28, 1991, now abandoned.

BACKGROUND OF THE INVENTION

1. Field of the Invention

The present invention relates to a bypass damper for use with a series-type ventilation fan. More specifically, the invention relates a damper designed to prevent the backspin of the fan.

2. Description of the Prior Art

A fan terminal is a popular product in the commercial heating, ventilation and air conditioning (HVAC) market. These fans are located in the ceiling, as part of the distribution ductwork near the space being ventilated. The function of the fan terminal is to draw in warm ceiling return air, when needed. Two types of fan terminals serve this purpose: the parallel-type and the series-type. In the parallel-type fan terminal, the fan is not located in the primary ventilation air flow path. The fan remains off until heat is needed, then it is energized and draws warm air from above the ceiling into its intake and discharges it into the ductwork downstream of a primary ventilation damper. In this case, both the primary damper and the fan are controlled by a thermostat in the space.

A series-type fan, on the other hand, is physically located in the primary ventilation air flow path. In this type of unit, the fan runs continuously. The primary damper discharges its air into a plenum surrounding the series fan, which is also open to the ceiling area. The suction effect of the fan prevents ventilation air from spilling out into the ceiling area. Typically, the capacity of the fan is variable and is adjusted to match the maximum cooling requirements of the space. Under the maximum cooling conditions, all of the cooling ventilation air is drawn into the fan intake and is discharged into ductwork downstream of the fan. This ductwork then feeds cooling air into the space. As the cooling requirements decrease, and the primary damper closes, the fan draws warmer ceiling air into the plenum, mixed with the reduced cooling air flow, and discharges this mix air into the downstream ductwork. The air flow to the space remains relatively constant, however the mix of cooled air to warmer ceiling air is changed.

A problem exists in a series-type fan terminal when the fan is shut off and restarted while the primary air flow exists. Series-type fan terminals typically use a forward curved blower and direct drive, permanent split capacitor (PSC) motor for low cost and high efficiency. If air is pushed through a forward curve blower that is de-energized, the blower will spin backward. If enough backward speed is generated, the PSC motor will run backward when energized. If this happens, the fan becomes loud, the blower wheel may loosen, and the motor may burn out. A series-type fan is susceptible to such problems when there is sufficient cooling air flow when the motor is de-energized (if the terminal was in its full heating mode, i.e. the primary damper closed, the fan, would restart properly), and the fan power is interrupted for a minimum of 20 to 30 seconds.

SUMMARY OF THE INVENTION

It is an object of the invention to prevent the backspin in a series-type fan. Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects in accordance with the purpose of the invention, as embodied and broadly described herein, the invention comprises a series-type fan terminal, comprising an air intake exposed to both ambient air and forced ventilation air; a fan having a variable capacity for blowing air in a stream from said air intake into a duct; and a primary port positioned downstream from the fan for allowing at least a portion of the forced air to bypass the fan.

Preferably, the damper is a flat plate mounted pivotably above the fan. The flat plate has its mass selected so that gravity causes the plate to extend essentially fully into the air outlet of the fan when the fan is not operating.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrates several embodiments of the invention and together with the description, serve to explain the principles of the invention.

DESCRIPTION OF THE PREFERRED EMBODIMENT

Reference will now be made in detail to the presently preferred embodiment of the invention, an example of which is illustrated in the accompanying drawings. Wherever possible, the same reference numbers will be used throughout the drawings to refer to the same or like parts.

Figure 1:
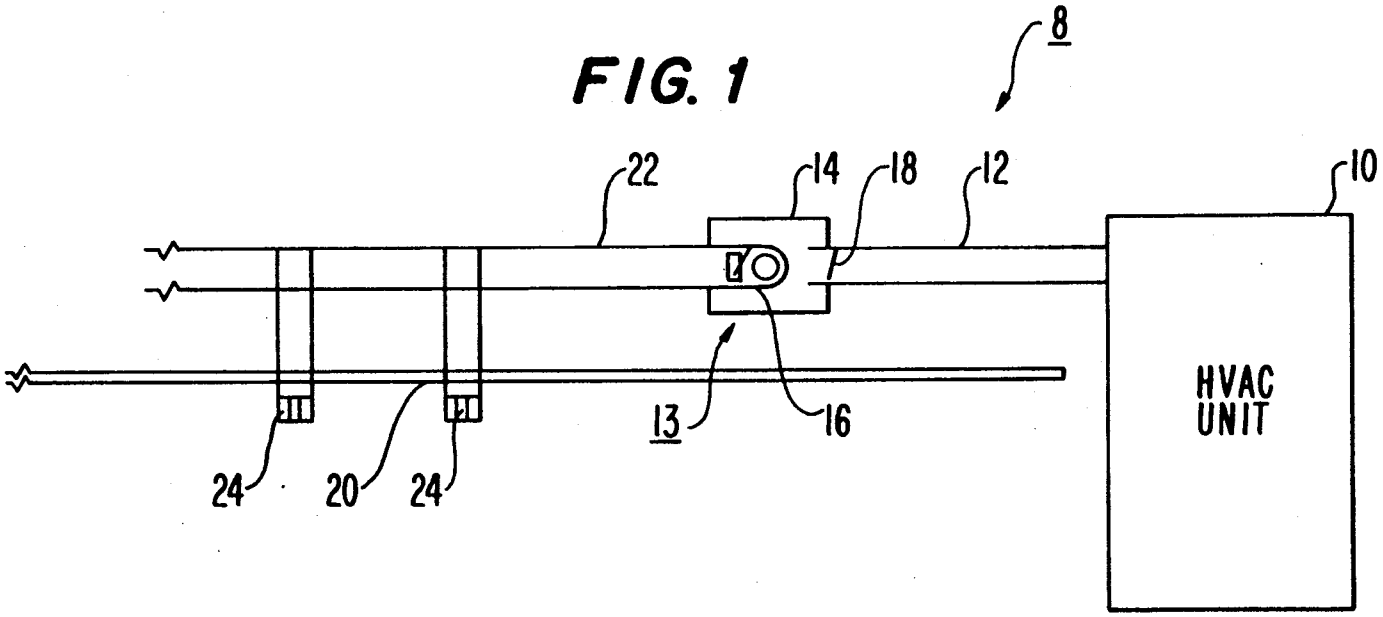
FIG. 1 depicts an HVAC system utilizing a series-type fan terminal according to the invention.

An HVAC system 8 using a series-type fan terminal 13, as addressed by this invention, is shown in FIG. 1. An HVAC unit 10 provides cooled air and a primary fan which forces air into primary duct 12. Primary duct 12 flows cooling air into plenum 14 around series-type fan 16. The flow of cooling air from primary duct 12 into plenum 14 is controlled by primary damper 18.

Plenum 14 is exposed to both cooling air from primary duct 12 and warm ceiling air from above ceiling 20. The ratio of cool to warm air can be adjusted by controlling cooling air flow from duct 12 and the operating capacity of fan 16. The mixed air is discharged into secondary duct 22 and further discharged from ventilation outlets 24.

In accordance with the present invention, a series-type fan has an air intake which is exposed to both ambient air and ventilation air. As embodied herein and shown in FIG. 5, primary duct 12 provides ventilation air 26 through damper 18 into plenum 14. Plenum 14 is also exposed to warm ceiling air 28. Fan air intake 30 draws the mixed air into fan 16.

In accordance with the present invention, the series-type fan terminal also has a variable capacity fan for blowing air in a stream into duct 22. As embodied herein and shown in FIG. 2, fan terminal 13 has a forward curved blower 32 and a direct drive, permanent split capacitor motor 34, which forces air into duct 22, and includes a combination volume, backdraft, and induction damper 42. As embodied herein, means for varying the fan capacity is included in the form of bent rod 43 reaching from the inside to the outside of the fan. Rotation of the bent rod blocks damper 42 from opening fully, thus limiting the air volume flow rate through the fan.

In accordance with the invention, the series-type fan terminal further has at least one induction port positioned downstream from the fan for allowing at least a portion of the forced air to bypass the fan. As embodied herein and shown in FIG. 6, ports 36 are located on each side of duct 22 after blower 32. In a preferred embodiment of the invention, ports 36 are 1 inch wide and 7–8 inches high.

Figure 5:
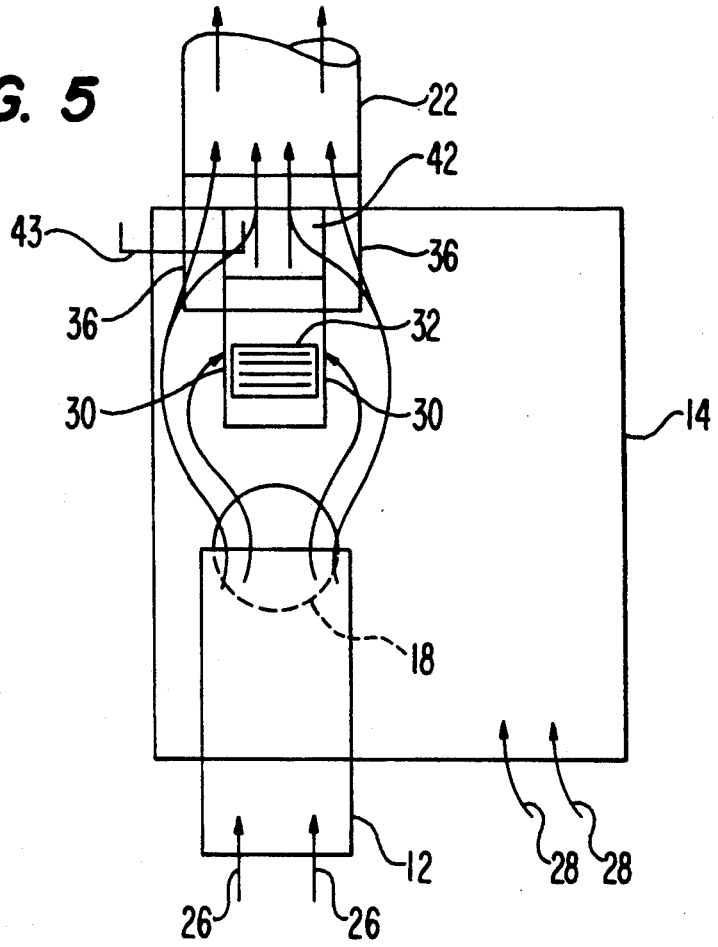
FIG. 5 is a top view of the fan terminal of FIG. 2.

As shown in FIG. 5, a portion of the air flow enters air intake 30. However a portion of the airflow bypasses air intake 30 and enters duct 22 through ports 36, due to an induced flow from the fan.

Figure 2:
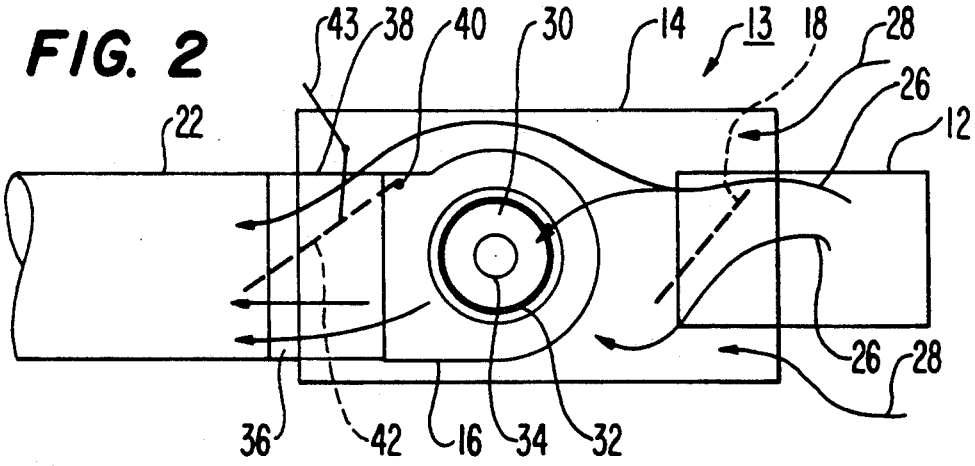
FIG. 2 is a cross-sectional side view of a series-type fan terminal according to the invention under low or medium flow conditions.

As shown and embodied in FIG. 2, series fan 16 also has a port 38 above combination damper 42. Port 38 provides substantially the same function as provided by ports 36, including allowing induced flow. However, at edge 40 of port 38, the damper 42 is attached. This damper is preferably a flat plate which is pivotable into and out of the airstream produced by blower 32.

Figure 3:
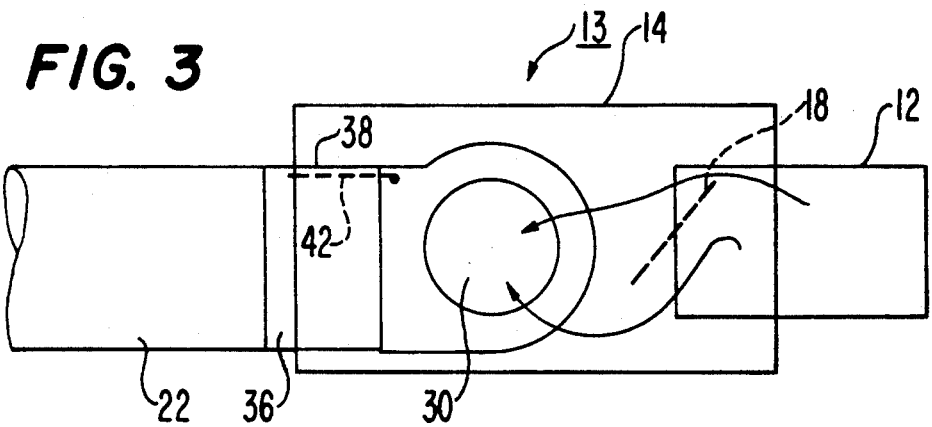
FIG. 3 is a cross-sectional view of the fan terminal of FIG. 2 under high discharge static pressure conditions, or high flow.
Figure 4:
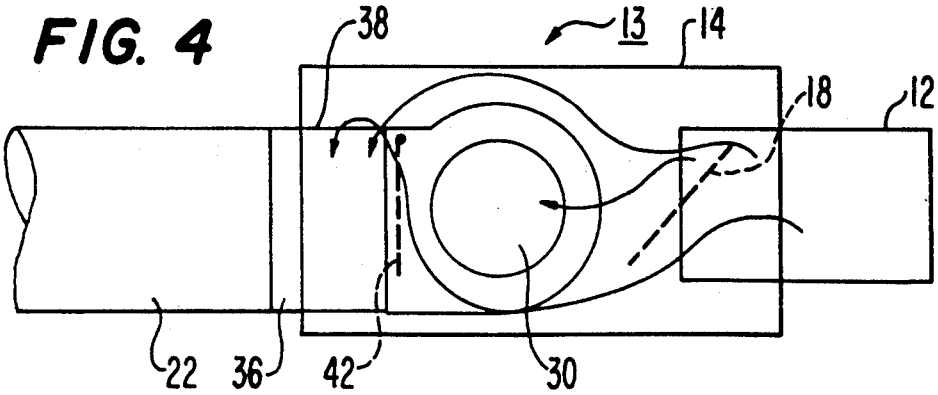
FIG. 4 is a cross-sectional side view of the fan terminal of FIG. 2 when the fan is de-energized.

As shown in FIG. 3, when blower 32 is operating at high capacity, a high static pressure is generated in duct 22 (for example 0.75 inches of water). The high static pressure causes damper 42 to pivot up to close port 38 and open full the fan. In contradistinction when the blower is de-energized, as shown in FIG. 4, the damper drops down to the closed position. This position substantially stops cooling airflow from passing through intake 30, and instead redirects the airflow through ports 38 and 36. In this way, the backspin of blower 16 is prevented.

Figure 6:
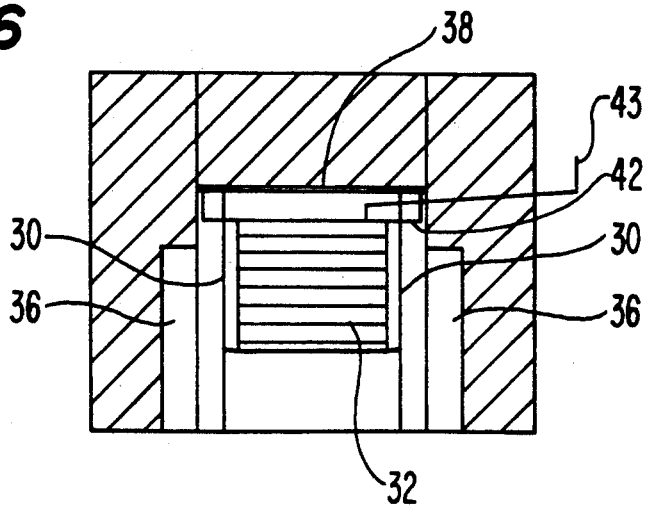
FIG. 6 is a view of the fan terminal of FIG. 2 from the discharge side of the fan terminal.

FIG. 6 shows damper 42 under normal operating conditions. Damper 42 is partially closed, blower 32 provides air flow into duct 22, additional air flow is induced through ports 36 and some additional induced airflow occurs through port 38. The induced airflow may be varied by varying the downstream distance between blower 32 and ports 36 in duct 22, as well as varying the size of the ports themselves. The shape of damper 42 may be varied so that the damper extends a predetermined amount into the airflow depending on the selected blower capacity, and thus the amount of induction and static produced can be adjusted.

Figure 8:
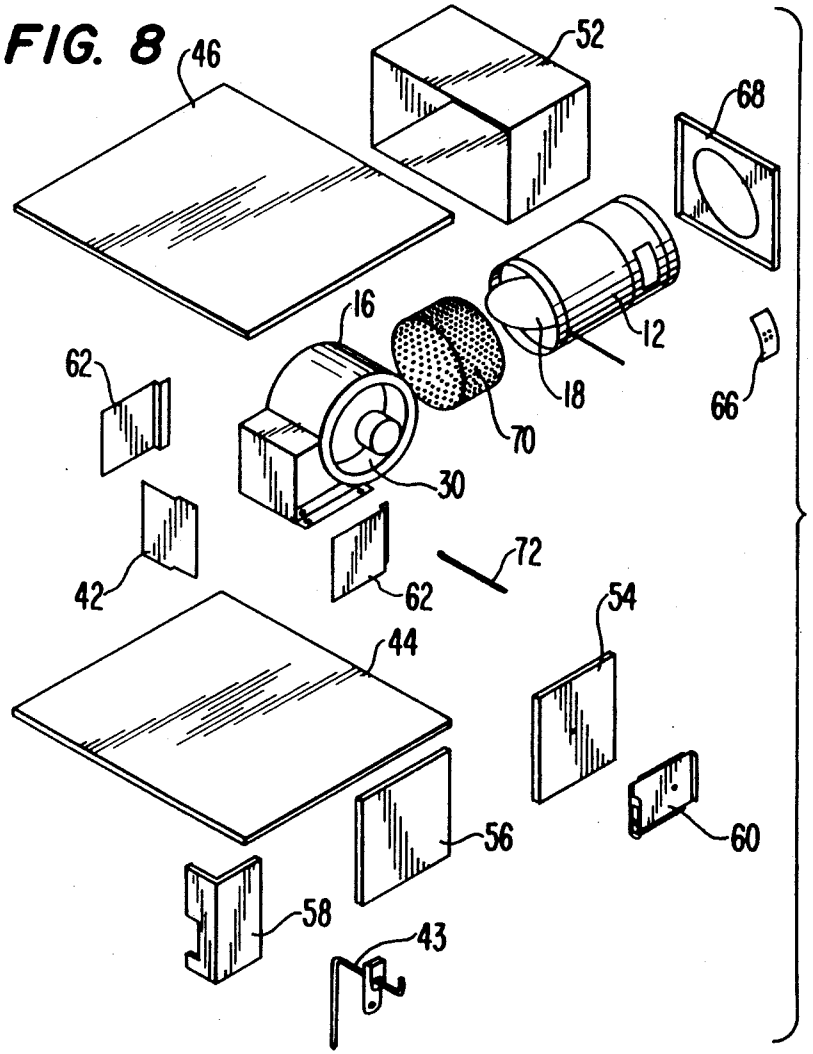
FIG. 8 is an exploded view of the fan terminal depicted in FIG. 7.
Figure 7:
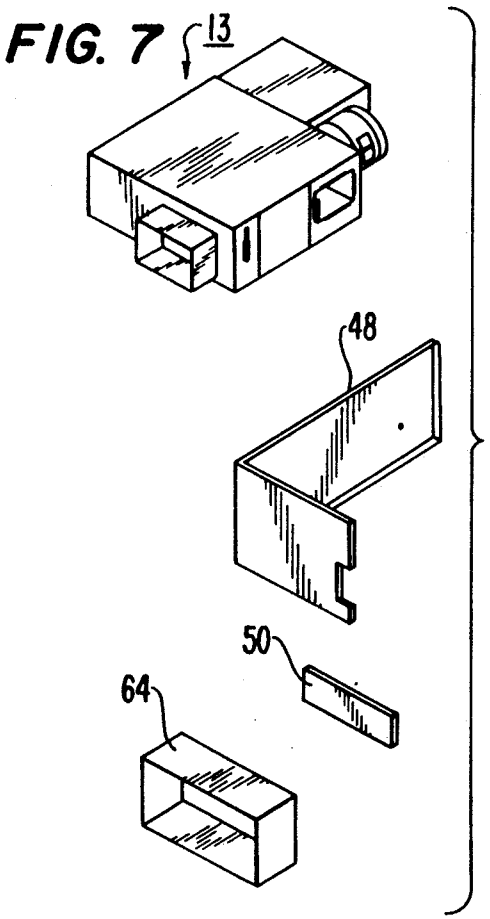
FIG. 7 is a perspective view of a preferred fan terminal according to the invention.

A preferred fan terminal 13 according to the invention is shown in FIG. 7, with FIG. 8 showing an exploded view. In general, casings and dampers in this preferred embodiment are constructed of 20 gauge zinc coated steel, and casings are lined with ¾ inch thick, dual density, coated fibrous glass insulation.

In the exploded view of FIG. 8, plenum 14 consists of bottom 44, top 46, right side 48, backside 50, intake boot 52, left side 54, motor access cover 56, left back 58, and control mounting plate 60. Air duct 22 includes air chute panels 62 and outlet collar 64. Air duct 12 includes damper 18, access door 66 and inlet plate 68. Backdraft damper rod 43 controls the amount of movement available for damper 42, which is hinged using hinge 72. A perforated attenuator 70 is located between duct 12 and air intake 30.

Figure 9:
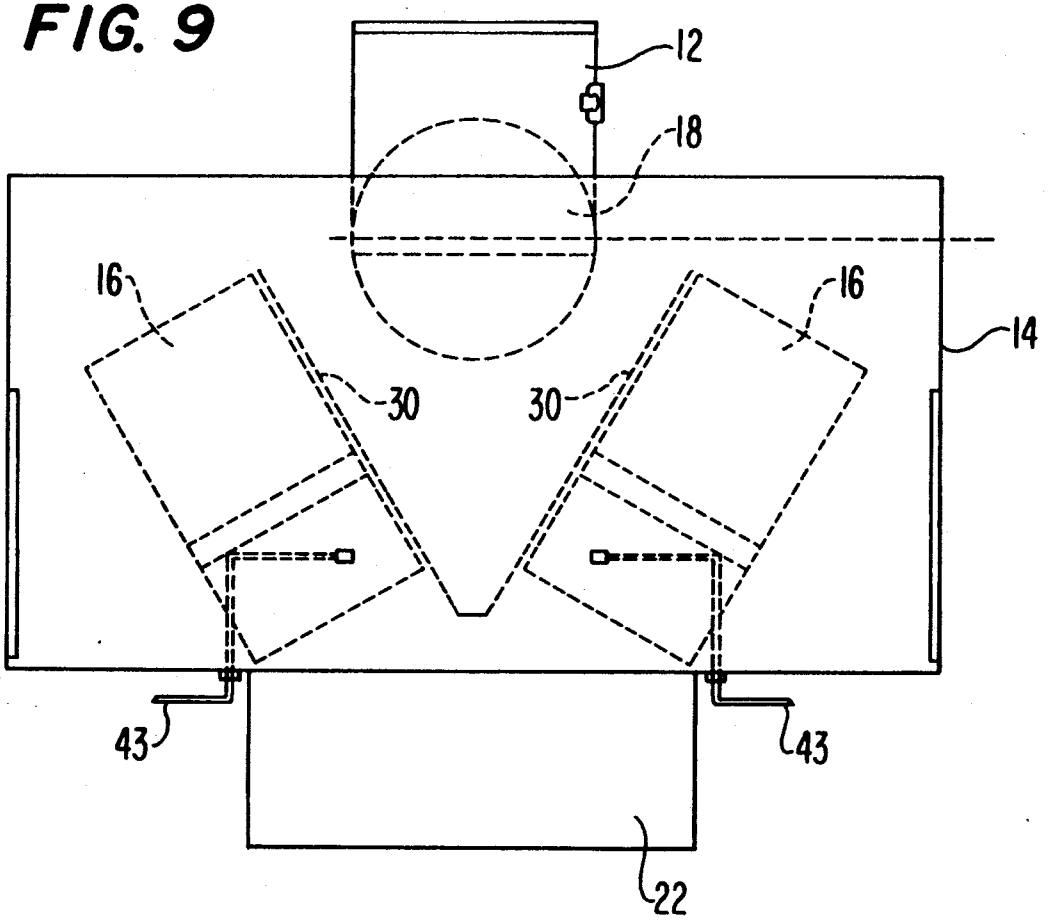
FIG. 9 depicts a fan terminal having two blowers.

Typical fans used in the preferred version create a static pressure of up to 1 inch water gauge and have supply capacities of up to 4000 cfm. In order to increase capacity of the fan terminal two fans each having its own motor may be used, as shown in FIG. 9.

It will be apparent to those skilled in the art the various modifications and variations can be made in the fan of the present invention and in the construction of this fan without departing from the scope and spirit of the invention.

Other embodiments of the invention will be apparent those skilled in the art from consideration of the specification and practice of the invention disclosed therein. It is intended that the specification and examples be considered as exemplary only with the true scope and spirit of the invention being defined by the following claims.

What is claimed is:

1. A series-type fan terminal, comprising:

an air intake exposed to both ambient air and forced ventilation air;

a fan having a selectively variable capacity for blowing air in a stream from said air intake into a duct, said fan including a forward curve blower and a direct drive permanent split type capacitor motor;

a primary port positioned downstream from said fan and in fluid communication with the air intake and the duct;

means for preventing reverse driving of said fan, when de-energized, by ventilating air flow from said air intake to said primary air port, said fan reverse driving preventing means including means for allowing a substantial portion of said forced air to bypass said fan;

a damper associated with said port; and means for positioning said damper to control the selected capacity of the fan.

2. The fan terminal as claimed in claim 1 further comprising at least one secondary port positioned downstream of the fan and in fluid communication with the air intake for allowing a further portion of the forced air and ambient air to bypass the de-energized fan.

3. The fan terminal as claimed in claim 1, wherein said primary port is above the airstream and said damper is pivotably supported at the port, and wherein the mass of the damper is selected such that the damper extends essentially fully into said air stream from the fan when the fan is not operating, thereby increasing the air bypassing the fan and restricting air passage through the fan.

4. The fan terminal as claimed in claim 3, wherein said damper comprises a flat plate.

5. A ventilation system, comprising:

a primary air duct for transferring forced air;

a secondary air duct, spaced from the primary air duct, for transferring said forced air and ambient air from a position between said primary and secondary ducts, the secondary duct having a top portion;

a fan, positioned serially between said primary and secondary ducts, having an air intake exposed to both said forced air and said ambient air, said fan having a variable capacity for forcing said ambient and forced air in a stream down said secondary duct, said fan including a forward curve blower and a direct drive permanent split capacitor motor;

means for preventing reverse driving of said fan, while de-energized, by ventilating air flow from said primary to said secondary air port, said fan reverse driving preventing means including a port positioned in the top portion of said secondary duct and in fluid communication with said air intake for allowing at least a portion of said forced air to bypass said fan; and a damper pivotably attached to said secondary duct proximate an edge of the port, wherein the mass of the damper is selected such that the damper extends essentially fully into the air stream through the fan when the fan is not operating.

6. The system as claimed in claim 5, wherein said damper comprises a flat plate.

7. A method of transmitting ventilation air, comprising the steps of:

blowing forced air into an area around a fan;

varying the fan capacity to blow a portion of the forced air and ambient air surrounding said fan into a discharge duct;

allowing a portion of said forced air to bypass said fan to prevent rotation of said fan in a direction opposite from a direction of rotation in which the fan operates to blow air into the discharge duct; and blocking airflow through the fan when the fan is not operating, thereby to further prevent backward spinning of the fan.

* * * * *